United States Patent [19]

Warringa et al.

[11] 4,132,965

[45] Jan. 2, 1979

[54] BAND-PASS FILTER CONSTRUCTED FROM CONCENTRICALLY ARRANGED COAXIAL RESONATOR CAVITIES

[75] Inventors: Jozef J. M. Warringa; Harry Piepers, both of Eindhoven, Netherlands

[73] Assignee: U.S. Philips Corporation, New York, N.Y.

[21] Appl. No.: 793,882

[22] Filed: May 4, 1977

[30] Foreign Application Priority Data

May 10, 1976 [NL] Netherlands ..... 7604950

[51] Int. Cl.[2] ..... H01P 1/20; H01P 7/06

[52] U.S. Cl. ..... 333/73 R; 333/73 W; 331/97; 333/83 R

[58] Field of Search ..... 315/39; 331/97; 333/73 R, 73 C, 73 S, 73 W, 83 R

[56] References Cited

U.S. PATENT DOCUMENTS

| | | | |
|---|---|---|---|
| 2,677,057 | 4/1954 | Haas | 315/39 |
| 2,679,591 | 5/1954 | O'Neill | 315/39 |
| 2,735,903 | 2/1956 | Williams | 331/97 |
| 2,779,895 | 1/1957 | Doolittle | 315/39 |
| 3,573,658 | 4/1971 | Hair et al. | 331/97 |

*Primary Examiner*—Alfred E. Smith
*Assistant Examiner*—Harry E. Barlow
*Attorney, Agent, or Firm*—Thomas A. Briody; David R. Treacy; Algy Tamoshunas

[57] ABSTRACT

A device comprising a band-pass filter comprising two concentrically arranged coaxial resonator cavities and a coupling capacitor disposed between these resonator cavities, wherein the bandwidth of the filter can be changed by means of a replaceable dielectric body disposed between the plates since the device is separable in two individually associated parts.

4 Claims, 1 Drawing Figure

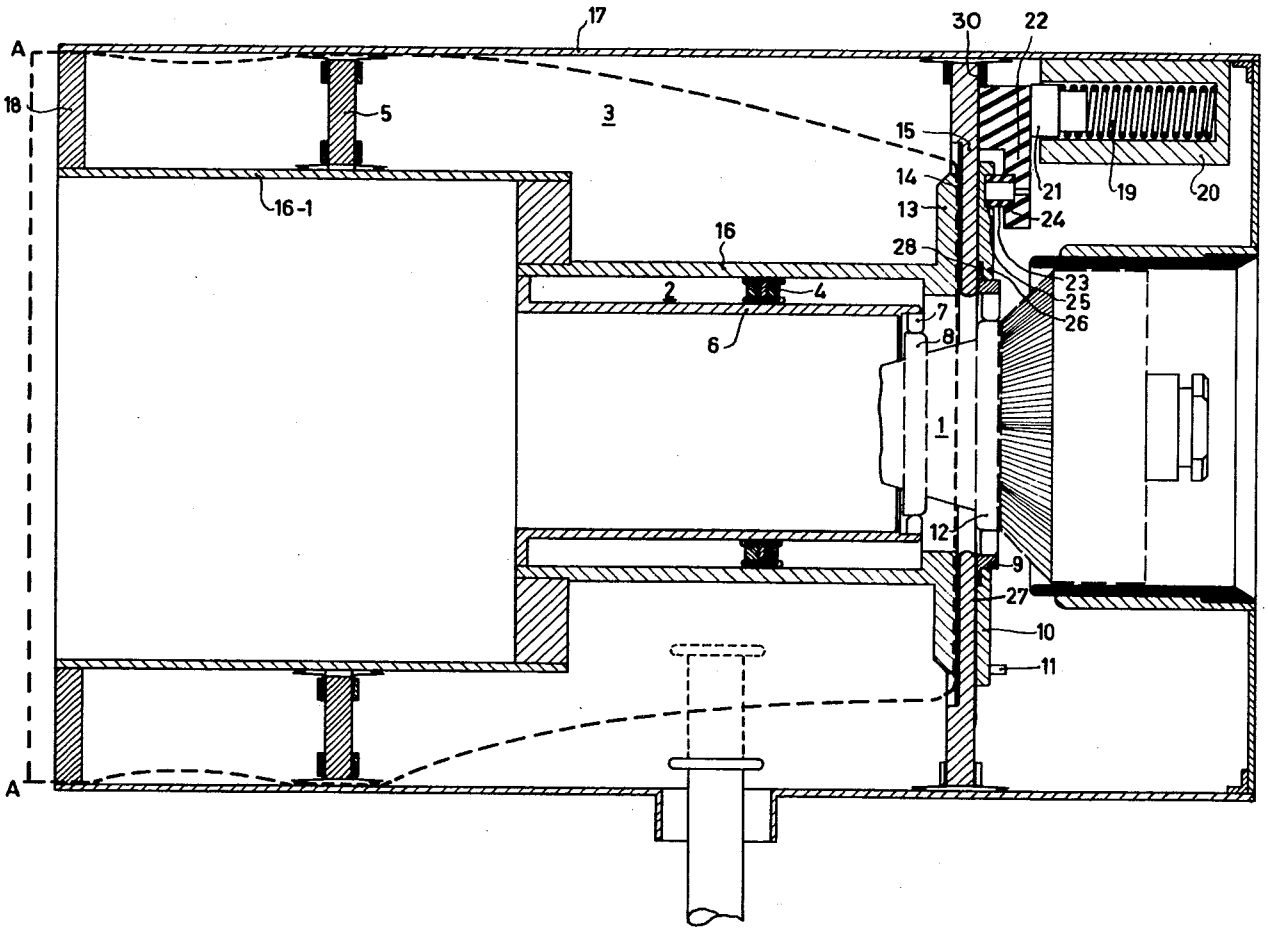
20
19
22
21
24
23
25
26
30
15
14
13
28
7
8
1
9
27
10
11
12
4
16
6
2
3
17
5
16-1
18
A
A

BAND-PASS FILTER CONSTRUCTED FROM CONCENTRICALLY ARRANGED COAXIAL RESONATOR CAVITIES

BACKGROUND OF THE INVENTION

The invention relates to a device provided with a band-pass filter comprising two concentrically arranged coaxial resonator cavities and a coupling capacitor for mutually coupling the resonator cavities, the coupling capcitor comprising two plates and an intermediate dielectric body.

Such a device is inter alia used as an amplifier device for a TV transmitter, operating in the frequency range from 470–1000 MHz. The band-pass filter can be tuned by means of short-circuit plungers arranged in the resonator cavities to one of the channel frequencies in the UHF band.

One problem with such an arrangement is that the bandwidth of such a band-pass filter depends on the operating frequency. To avoid this, it is known to dimension during manufacture the amplifier device for a given TV channel by giving the dielectric body disposed between the capacitor plates a thickness which is specific for that channel frequency.

This has inter alia the drawback that a multichannel relay station must have a spare amplifier device for each TV channel and that preparing the coupling capacitor or, possibly, replacing this capacitor by another one is very elaborate and time-consuming.

It is an object of the invention to obviate these drawbacks in a very simple manner.

SUMMARY OF THE INVENTION

The device in accordance with the invention is characterized in that it can be separated into two individually associated parts, one plate of the coupling capacitor belonging to one part and the other plate of the coupling capacitor belonging to the other part.

This has inter alia the advantage that an identical amplifier device can be used for each TV channel in the UHF range and only different dielectric bodies, which can be mounted or exchanged very rapidly, need be kept in store for the various channels.

BRIEF DESCRIPTION OF THE DRAWING

The invention and its advantages will be further explained with reference to the FIGURE which shows the band-pass filter of the invention.

DETAILED DESCRIPTION

The FIGURE shows a portion of an amplifier device with a tetrode 1. The device includes a band-pass filter which is formed from two concentrically arranged coaxial resonator cavities 2 and 3 and a coupling capacitor 13, 14 and 15. The resonator cavities 2 and 3 are provided with ring-shaped plungers 4 and 5 for adjusting the resonant frequencies of the resonator cavities 2 and 3 within wide limits.

The innermost cylindrical conductor 6 is provided at the top with a first contact ring 7 for connecting the conductor to a ring-shaped contact 8 which is connected to the screen grid of the tetrode 1 in order to supply to the screen grid, via conductor 6, a screen grid bias voltage required for the operation of the tetrode 1.

A dc voltage is supplied to the anode of the tetrode 1 by a second contact ring 9, and a flat ring 10 provided with a terminal 11. Ring 9 is in contact with a ring-shaped contact 12 conductively connected to the anode of tetrode 1.

The coupling capacitor by means of which the resonator cavities 2 and 3 are mutually coupled comprises a first plate in the form of a ring-shaped flared edge or flange 13 on a cylindrical conductor 16 which constitutes the common partition of the resonator cavities 2 and 3, a dielectric body 14 arranged on flange 13 and a second plate formed by a flat ring 15 of a conducting material. Ring also serves as the cover of the resonator cavity 3. The capacitance of this capacitor is determined by the size of the mating surfaces of the flange 13 and the ring 15 and by the thickness, the inside and outside diameters and the dielectric constant of ring 14. Since the bandwidth of the band-pass filter at the operating frequency is determined by the capacitance of this capacitor, the bandwidth for another operating frequency of the amplifier can be obtained by replacing the dielectric ring 14 with another one having a larger inside diameter or a smaller outside diameter, a different thickness, a different dielectric constant, or a combination of these properties.

In accordance with the invention, the device is assembled from two individually associated parts to enable easy and rapid exchange of the dielectric ring 14. One of these individually associated parts is shown in the FIGURE as surrounded by the dotted line A. The two parts are coupled to one another because the outermost coaxial conductor 17 is detachably connected in a manner not further shown, for example, by means of bolts or screws to the bottom part 18 of the resonator cavity 3.

Applying or replacing respectively the ring 14 when adjusting to another operating frequency is performed as follows.

The outer conductor 17 is detached from the bottom part 18, for example by unscrewing the mounting bolts. The outer conductor 17 together with the ring 15 are then removed so that the space between the capacitor plates 13 and 15 is accessible. After the dielectric ring 14 is mounted or replaced, the ring 15 together with the outer conductor 17 is pushed in its place and secured. The amplifier device is then again ready for use.

It should be noted that a possible poor electric contact caused by the detachable connection between the outer conductor 17 and the bottom part 18 has no influence on the operation of the resonator cavity 3 because the wall currents of the resonator cavity flow through the short circuit plunge 5.

Furthermore it should be noted that in a preferred embodiment, the ring 14 is assembled from a plurality of stacked foils or sheets, matching of the bandwidth can be effected by removing or adding foils.

The varying thickness of the ring 14 in such an arrangement is compensated for by the fact that the ring 15 is axially movable and resiliently within the conductor 17 by means of a plurality of resilient elements which are disposed equidistantly along the circumference of the outer conductor. The FIGURE shows only one of these elements which comprises a spring 19. Spring 19 is kept in place by means of a bushing 20 which is fixed to the outer conductor 17. The spring presses, via a die 21 and a pressure element 22, which is composed of insulating material, against the ring 15.

In a manner not shown in the drawing the cover 15 may be connected, for example by means of clamping bolts to the outer conductor 17, the bolts permitting a limited axial movement of the cover 15. This has the advantage that when the outer conductor 17 is removed the cover 15 can be removed at the same time. The different thicknesses of the ring 14 are compensated for by the space which is available between the bushing 20 and the pressure element 22. A properly conducting contact between the ring 15 and conductor 17 is obtained by means of the contact springs 30 disposed on the outer edge of the ring 15.

It should be noted that a plate of the coupling capacitor may also be formed by a ring which is fixed to the conductor 17 and the other plate by a ring which is movably applied around an extended conductor 16 with a dielectric ring 14 disposed between the rings etc.

Furthermore the coaxial outer conductor 17 and the portion 16 - 1 of the inner conductor of the resonator cavity 3 may have a rectangular cross-section, the plunger 5 and the cover 15 also being rectangular. In that case only one of the four wall portions of the conductor 17 need be removed together with the cover 15 which has the advantage that the space between the plates 13 and 15 is accessible in a still simpler and more rapid manner.

To be able to derive the anode ac voltage signal and to block the anode dc voltage a ring of dielectric material 27 is disposed between the ring 10 and the contact ring 9, on the one hand, and the ring 15, on the other hand. Furthermore the pressure element 22 is provided with a portion extending above the ring 10 which portion is provided with a blind hole 24 in which an end of a bush 23 of ceramic material is fitted. The other end of this bush 23 is fitted in a blind hole 25 of the ring 10 so that this ring 10 is kept centered by means of a heat-resistant and heat-insulating element. A lug 26 of the ring 10 bends over an edge 28 of the contact ring 9 by means of which this contact ring is kept in its place. Furthermore, the ring 10 and the contact ring 9 keep the dielectric ring 27 in its place.

What is claimed is:

1. A band-pass filter comprising a first cylindrical conductor, a second cylindrical conductor coaxial with and spaced from said first conductor to define a first resonator cavity therebetween, a third cylindrical conductor coaxial with and spaced from said first conductor to define a second resonator cavity therebetween, a pair of annular electrically conductive plates arranged in superposed relationship about one end portion of said first conductor and a dielectric member disposed between said annular plates to form with said plates a capacitor which mutually couples said first and second cavities and determines the bandwidth of the band-pass filter, said third conductor being detachably secured to said first conductor to permit replacement of said dielectric member with a different dielectric member to thereby change the capacitance of said capacitor and the bandwidth of the filter.

2. The filter according to claim 1 wherein one of said annular plates is affixed to said first conductor and said third conductor is the outermost conductor, the other annular plate of said pair being mounted for axial movement within said third conductor, and including means for resiliently pressing said other plate against said dielectric member.

3. The filter according to claim 2 wherein said means includes a plurality of springs positioned about the inner wall of said third conductor opposite said one annular plate and arranged to exert a resilient force against said other plate.

4. The filter according to claim 3 wherein said dielectric member comprises a stack of annular dielectric foils.

* * * * *